US005197543A

United States Patent [19]

Coulter

[11] Patent Number: 5,197,543

[45] Date of Patent: Mar. 30, 1993

[54] HORIZONTAL WELL TREATMENT METHOD

[75] Inventor: Gerald R. Coulter, Plano, Tex.

[73] Assignee: Oryx Energy Company, Dallas, Tex.

[21] Appl. No.: 851,316

[22] Filed: Mar. 16, 1992

[51] Int. Cl.[5] ..... E21B 33/13; E21B 37/08; E21B 43/27; E21B 49/00

[52] U.S. Cl. ..... 166/250; 166/50; 166/281; 166/387

[58] Field of Search ..... 166/50, 387, 381, 380, 166/281, 227, 307

[56] References Cited

U.S. PATENT DOCUMENTS

| | | | |
|---|---|---|---|
| 1,389,007 | 8/1921 | Norbye . | |
| 2,173,119 | 9/1939 | Layne . | |
| 4,714,117 | 12/1987 | Dech | 166/380 |
| 4,878,539 | 11/1989 | Anders | 166/303 |
| 5,074,360 | 12/1991 | Guinn | 166/281 |
| 5,090,481 | 2/1992 | Pleasants et al. | 166/50 X |
| 5,107,927 | 4/1992 | Whiteley et al. | 166/50 |

OTHER PUBLICATIONS

Cooper, R. E. and J. C. Troncoso, SPE 17582, "An Overview of Horizontal Well Completion Technology".

*Primary Examiner*—Stephen J. Novosad

*Attorney, Agent, or Firm*—Pravel, Hewitt, Kimball & Krieger

[57] ABSTRACT

Methods are provided for isolating segments of a horizontal wellbore drilled through an unconsolidated formation and treating the well to control rates of fluid flow into selected segments of the wellbore. The methods include screen segments separated by blank pipe segments to provide isolation outside the tubulars upon collapse of the surrounding formation around the blank pipe segments.

19 Claims, 2 Drawing Sheets

HORIZONTAL WELL TREATMENT METHOD

BACKGROUND OF THE INVENTION

1. Field of the Invention

This invention relates to a method of treating a well which has been drilled through an unconsolidated formation in a substantially horizontal direction. In particular, methods are provided for effective flow isolation of selected segments in the substantially horizontal portion of the wellbore by the use of screens and blank pipe and for treating the well to control flow rate of fluids into selected segments of the wellbore.

2. Description of Related Art

In recent years it has become common to drill wells which penetrate the earth in a substantially vertical direction to a selected depth and then deviate from vertical to reach a direction which is substantially horizontal or which is substantially along the bedding planes of the formation being penetrated. The horizontal portion of such wells may extend for as much as hundreds of feet in the same formation. Such horizontal wells are advantageous for producing hydrocarbons from unconsolidated or consolidated formations. Particular advantages may accrue in thin formations, heterogeneous formations, formations having natural fractures in the vertical direction, and in formations where water or gas coning limits the production rate of oil. A horizontal well will normally allow production at a higher rate than a vertical well in the same formation.

A serious limitation of horizontal wells has been the means for "completing" the well. Such completion means preferably allow for controlling or altering the pattern of flow of hydrocarbons and water from selected portions of the wellbore. Some horizontal wells have been drilled and produced from the open hole. This method of production can be practiced in formations where the rock is sufficiently strong for the wellbore to remain open with production, but an open hole provides limited means to alter the pattern of flow from selected portions of the wellbore. In most wells, it is very desirable to be able to alter the pattern of fluid entry into the well. When the horizontal well is drilled through consolidated rock, the casing of the well may be cemented in place and then perforated, which provides a completion means for selectively altering the pattern of fluid entry into the well. When the horizontal well is drilled through unconsolidated rock, a liner made up of pipe containing narrow slots to allow flow into the wellbore (a "slotted liner") or a screen liner is commonly placed in the well. The screen has openings small enough to prevent flow of grains from the formation through the liner and into the wellbore. With the slotted liner or screen liner in the wellbore, it is not possible with conventional methods to control flow rate into the wellbore at different locations along the liner.

The method of cemented and perforated casing or liner is not a suitable method for completing horizontal wells in unconsolidated formations, because the grains of formation rock will flow through the perforations and into the liner, where they will accumulate and retard or prevent flow from the well. An inside-casing screen and gravel pack can be used, but this usually causes an excessively high resistance to flow into the well, does not allow for isolation or control of flow patterns along the wellbore and is an expensive method of completion.

A variety of techniques used in completing horizontal wells have been summarized in the paper "An Overview of Horizontal Well Completion Technology." (SPE Paper No. 17582, Society of Petroleum Engineers, 1988) One of the techniques discussed in this paper is the possible use of uncemented liners having predrilled holes in segments of the liner, these segments being separated by "blank sections." "Blank" sections or "blank" pipe refers to pipe having no holes. The possible collapse of the formation around the blank sections to provide isolation of the predrilled segments is discussed. The method would not be suitable in an unconsolidated or poorly consolidated formation, however, as the grains of the formation could enter the liner through the predrilled holes.

Equipment has been developed which is designed to prevent flow of fluids outside a liner pipe or casing in horizontal wells. A method for completing a horizontal well by employing this equipment, called an "external casing packer," is described in U.S. Pat. No. 4,714,117. This method employs a casing string composed of alternating casing subs and external casing packer subs. The method provides for isolation of discreet segments of the casing string to allow for localized production and remedial treatments in the horizontal portion of the wellbore.

To determine the need for selectively controlling the influx of fluids into a wellbore, flowmeters to measure the flow rate of fluids in a wellbore along the length of the wellbore are available in industry. Also available to be employed with the flowmeter or alone are logging instruments (based on measurements of density or dielectric constant, for example) to determine the relative amounts of gas, water and oil in the flowing stream in the wellbore. In a horizontal well, these flowmeters and logging instruments to determine relative amounts of different fluids may be placed in the well on rigid tubing which can push the instrument along the horizontal portion of the wellbore.

There is a continuing need for an inexpensive method to complete horizontal wells drilled into unconsolidated or poorly consolidated formations so as to allow selective production of fluids from the wells and selective treatment to increase or decrease flow rate from selected segments along the horizontal wellbore.

SUMMARY OF THE INVENTION

There is provided a method of controlling flow rate into a horizontal well along selected segments of the horizontal portion of the wellbore drilled through an unconsolidated or poorly consolidated formation. In one embodiment, screens are joined to blank liner pipe segments and placed in the wellbore. Sufficient time is allowed for the surrounding formation to close around the blank liner segments and screen. A selected segment of screen in the wellbore is isolated by packers in blank pipe segments and a treatment fluid is injected into a screen segment. In another embodiment, a horizontal well containing segments of screen separated by blank pipe is treated by placing packers in blank pipe segments and injecting a treating fluid into the screen segment. In another embodiment, the flow resistance outside blank pipe segments is measured before the treating fluid is injected.

DESCRIPTION OF PREFERRED EMBODIMENTS

Figure 1:
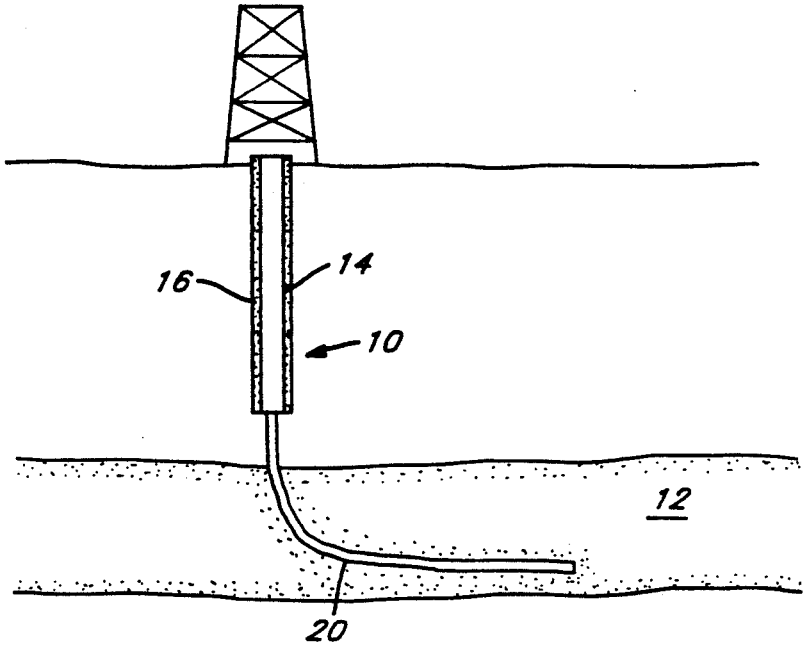
FIG. 1 shows a well drilled through the earth in the vertical direction and deviated into the horizontal direction, penetrating a productive zone in the earth in the horizontal direction.

Referring now to FIG. 1, horizontal well 10 has been drilled in a vertical direction through the earth and then deviated to penetrate the productive formation 12 for a substantial distance more than the thickness of the formation 12. Whether the productive formation 12 is in a horizontal direction or not, if the wellbore is drilled at an angle so as to penetrate the productive formation for a distance substantially more than the thickness of the formation, the well is defined herein as a "horizontal well." Casing 14 has been placed in the well and cemented in place by cement 16 before the horizontal section of the well was drilled. An open hole exists below the shoe of the casing 14. Fluids could not be produced through the open hole 20 because the formation 12 would collapse to close the hole; but even if fluids could be produced from the well through the open hole 20 penetrating the formation 12, there would be no means to control the flow pattern of the fluids entering the open hole.

Figure 2:
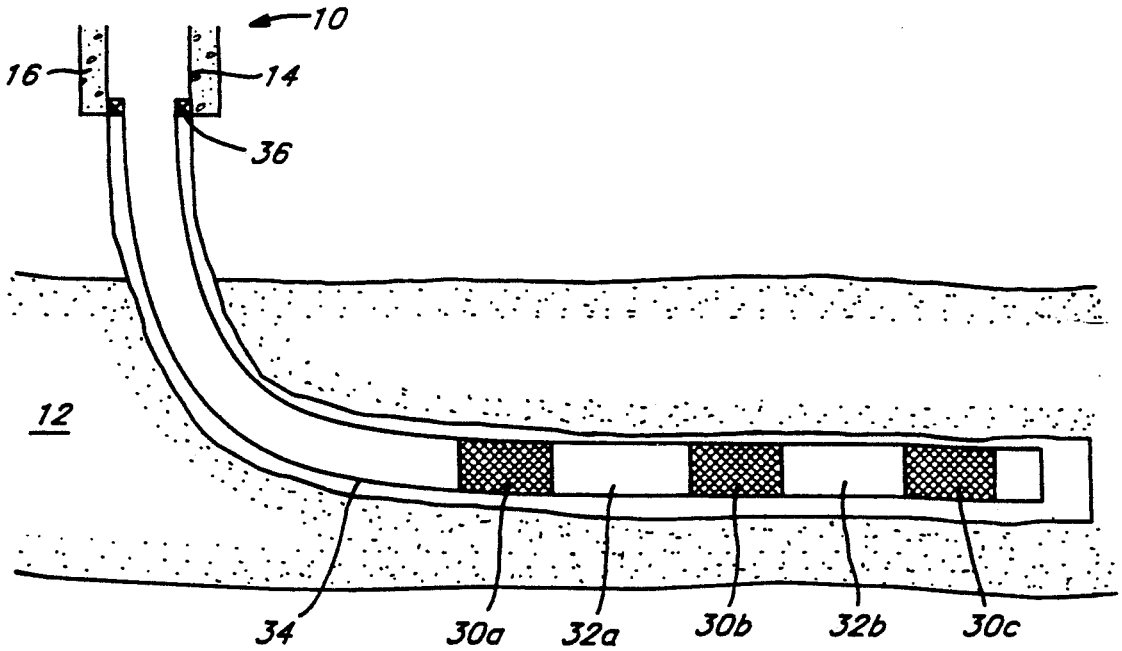
FIG. 2 shows the horizontal section of a well completed with screen segments separated by blank pipe segments, prior to collapse of the surrounding formation around the screen and pipe segments.

In FIG. 2, screen segments 30(*a*), 30(*b*) and 30(*c*) and blank pipe segments 32(*a*) and 32(*b*) are shown in wellbore 10, drilled in a horizontal direction through formation 12. The screen segments and blank pipe segments are attached to a liner 34, which has been placed in an open hole, such as the open hole 20 of FIG. 1, using conventional techniques. A liner hanger 36 seals the annulus between the liner 34 and the casing 14 in the well. The same numerals are used to denote the same components in all figures.

The screen segments 30(*a*), (*b*) and (*c*) are available in different sizes from Baker Sand Control Company, Howard Smith Company, Houston Well Screen Company and other companies. Conventional metal screens or slotted liners may be used, but preferably the screen segment is a prepacked screen. A prepacked screen contains particles which are consolidated into a permeable filter. Such a screen is available, for example, from Baker Sand Control Company of Houston, Tex. The screen may be made from sintered materials. The diameter of the screen or liner is selected based on the size of the hole drilled through the formation. The size of openings in the screen or the slot width may be selected based on samples of the formation rock, if such samples are available, using conventional techniques well-known in industry for sizing the openings of screens to exclude particles of known dimensions. For application of our invention, the formation rock 12 is unconsolidated or poorly consolidated, such that the rock will collapse around the pipe segments and limit or prevent flow outside the pipe segments.

Figure 3:
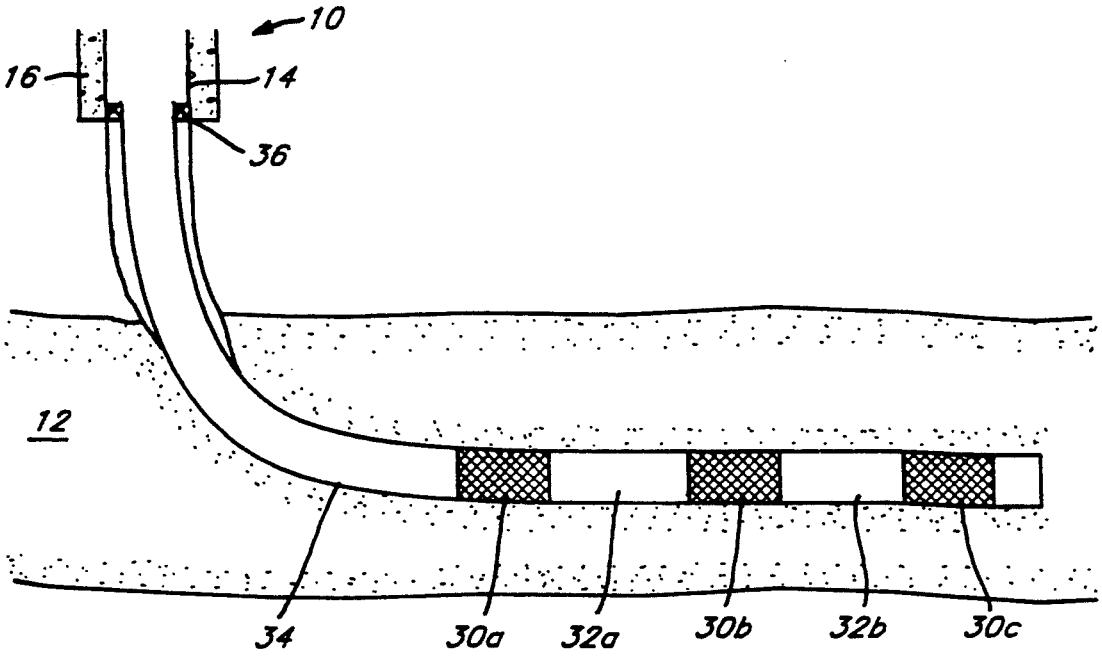
FIG. 3 shows the same horizontal section of the well after the surrounding formation has collapsed around the blank pipe and screen segments.

In FIG. 3, the formation rock 12 has collapsed around the liner 34, the screen segments 30 and the blank pipe sections 32. The collapse of the formation rock 12 is caused by stresses in the earth and the lack of consolidation of the grains of the rock. Production of fluids through the screen segments 30 may decrease the time required for the rock 12 to collapse around the tubular members 34, 30 and 32, but collapse may occur in the absence of production from the well.

The formation 12 is packed against the outside walls of the tubular members and serves to prevent excessive flow of fluids along the outside surface of the tubular members. Thus, effective flow "isolation" outside the tubulars of the separate screen sections 30(*a*), 30(*b*) and 30(*c*) is obtained, although a hydraulic seal is not present outside the tubular members. For example, if fluid having a viscosity of 1 cp is injected at a rate of 2 barrels per minute into a screen only 1 foot in length, and the permeability of the formation rock around the screen is 2 Darcies, the radial pressure drop in the formation opposite the screen will be about 1400 psi. Approximating flow along blank pipe as linear flow, the pressure drop along a blank pipe with the same permeability formation in a thickness of 1½ inches around the blank pipe would be about 4000 psi per foot. To provide effective flow isolation between screen segments, the blank pipe between screen segments should have a minimum length of about 10 feet, and this length is preferably at least 20 feet. Thus, the blank pipe 32 will, after collapse of the formation around the pipe, provide isolation between screen segments 30 for injection of fluids into selected screen segments or production of fluids from selected screen segments. It may be desirable to inject treating fluids into selected screen segments after the formation 12 has collapsed around the tubulars and before the well is produced.

Figure 4:
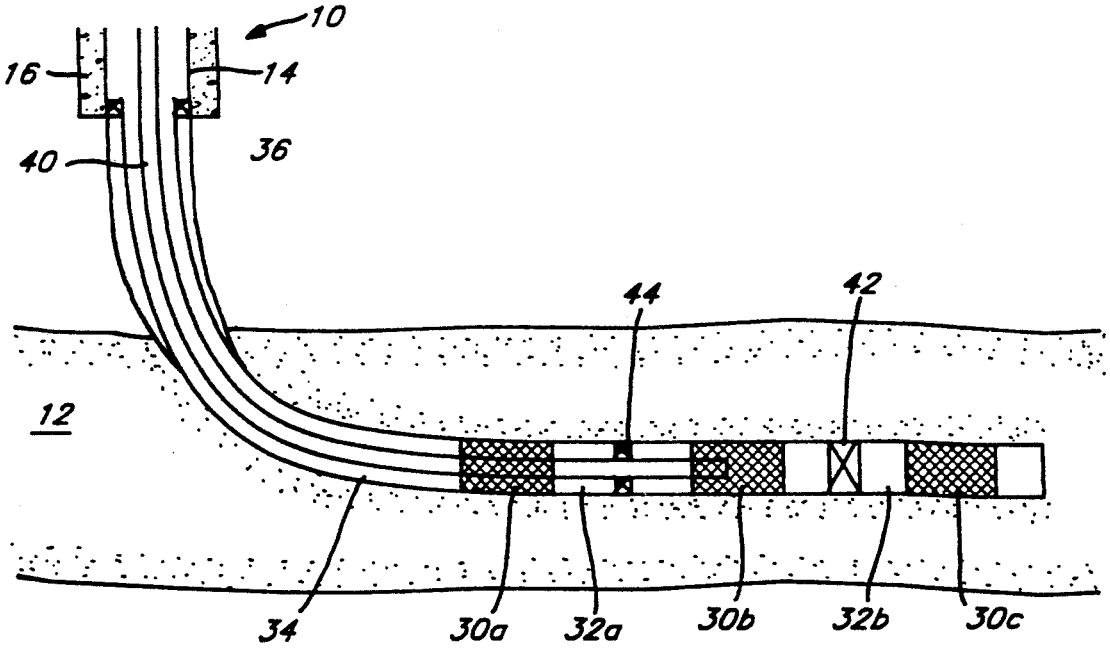
FIG. 4 shows a workover string and packers in place the horizontal section of a well to inject a treating fluid into a screen segment.

FIG. 4 shows additional equipment which has been placed in well 10 for isolating segments of the wellbore by packers and selectively injecting fluids into one of the screen segments 30 or producing fluids from the selected segment. The additional equipment consists of a workover string or tubing 40 having attached to it a retrievable packer 44. A bridge plug 42, which serves as a packer, has been placed in the well below the selected screen segment 30(*b*). The packer 44 has been placed above the selected screen segment 30(*b*) and set by conventional methods known in industry. Optionally, a straddle packer mounted on the work string 40 is set in blank pipe segments on each side of a screen segment to isolate a screen segment.

With the configuration of equipment shown in FIG. 4, it is possible to determine if the formation 12 has collapsed around a blank pipe section. For example, brine or oil can be injected down the workover string 40 at a known pressure and flow rate. The pressure at the lower end of the workover string, which will be the injection pressure into screen segment 30(*b*), can be calculated for that flow rate. The pressure in the annulus outside the workover string 40 at the location of the screen segment 30(*a*) can be calculated from the return flow rate through the annulus between the workover string 40 and the casing 14. The difference in pressure between screen 30(*a*) and 30(*b*) will indicate the resistance to flow outside the blank pipe 32(*a*), which will indicate if the formation 12 has collapsed around the blank pipe.

If it is desired to decrease the flow rate of fluids entering the well 10 through the selected screen segment 30(*b*), the treatment fluid is a plugging liquid which is injected through the workover string 40 and out through the screen segment 30(*b*). The plugging liquid may be a water solution of a polymer, a cement slurry made from very fine particles or other materials. If it is desired to increase the flow rate of fluids entering the well 10 through the selected screen segment 30(*b*), the treatment fluid is a stimulation fluid. Similarly, the stimulation fluid is injected through the workover string 40 and out through the screen segment 30(*b*). Suitable stimulation fluids are acids, surfactants, solvents (including water), or mixtures of these materials. Such stimulation fluids may contain particulate diverting materials which are sized to pass through the screen or slotted liner and deposit in the surrounding formation to divert flow of injected fluid more evenly into the formation along the screen segment.

To determine the flow rate of fluids into the different screen segments while the well is being produced, which will indicate which screen segments should be decreased in flow rate and which segments should be stimulated, a flow meter can be run into the well while the well is being produced. Techniques are available for running such flowmeters in horizontal wells by attaching the flowmeters to coiled tubing or other tubing, such that the tools can be pushed through the horizontal portion of the well. Such techniques are well-known in industry. Also, logging devices can be run either alone or in combination with a flow meter to determine the composition of the fluid entering the wellbore at each distance along the wellbore. Such devices, normally based on density, dielectric constant, or electrical resistivity measurements, are well-known in industry.

EXAMPLE 1

An offshore field is to be developed with several horizontal wells drilled from a platform. The primary purpose of having horizontal wells rather than vertical wells is to delay entry of water production coming from a cone of water rising from the oil-water contact. Water coning would occur quickly around vertical wells when produced at the high rates necessary to make the field commercial. The formation which is productive of oil is unconsolidated or has very low mechanical strength. Therefore, it will be necessary to complete the wells with provisions to prevent sand particles from the formation entering the wellbores along with the produced fluid from the formation.

An analysis of options for completing the horizontal wells indicates that the most effective completion will be a prepacked screen in the open hole without a gravel pack outside the screen. There is concern, however, that water will break through prematurely into a part of the screen because of heterogeneous rock permeabilities along the length of the horizontal portion of the well. It is decided to separate 20-foot long segments of the prepacked screen with 40-foot long blank pipe segments. Five screen segments and five blank pipe segments are attached to the bottom of a liner and placed in the open hole drilled below the cemented casing in the vertical portion of the well. When the well is produced, there is time for the formation around the horizontal section of the wellbore to collapse around the liner, screen and blank pipe segments before water breaks through into the horizontal well. When water breakthrough occurs, a logging instrument which measures fluid density and dielectric constant is run in the well while it is being produced to determine through which screen segment the water is being produced. A flowmeter is run in combination with the logging instrument to determine the flow rate through each screen segment.

After it is determined which screen segment is producing the unwanted water into the well, the well is shut-in and killed by injecting a dense fluid, the production tubing is pulled from the well and a workover tubing string is used to place a bridge plug in the blank pipe section below the screen segment where water entry is occurring. Then the workover string with packer attached is run into the well and the packer is set in the blank pipe just above the screen segment where water entry is occurring. A cement slurry made of very fine cement particles, sold as "Matrix Cement" by Halliburton Company of Duncan, Okla., is injected down the workover string and through the selected screen segment. The workover string is flushed to remove remaining cement slurry and removed. After allowing the cement to cure in the formation, the well is placed back on production. Water production from the well is greatly decreased.

The invention has been described with reference to its preferred embodiments. Those of ordinary skill in the art may, upon reading this disclosure, appreciate changes or modifications which do not depart from the scope and spirit of the invention as described above or claimed hereafter.

What I claim is:

1. A method for treating a horizontal well drilled through an unconsolidated subsurface formation comprising:

(a) placing in the horizontal portion of the wellbore at least two screen segments separated by segments of blank pipe joined to the screen segments;

(b) allowing sufficient time for the subsurface formation to collapse around the segments of blank pipe so as to increase the resistance to flow along the outside of the blank pipe;

(c) placing packers on a workover string in blank pipe segments of the well; and (d) treating a selected screen segment by injecting a treatment fluid to alter the resistance to flow through the screen segment into the wellbore.

2. The method of claim 1 wherein after step (a) and before step (c) the well is produced and the composition of fluid or flow rate of fluid entering the well through one or more screen segments is measured while the well is producing.

3. The method of claim 1 wherein after step (c) and before step (d) the resistance to flow along the outside of a segment of blank pipe in the well is measured.

4. The method of claim 1 wherein in step (d) the resistance to flow through a selected screen segment is increased by injecting a plugging fluid through the segment.

5. The method of claim 4 wherein the plugging fluid is a cement slurry having finely ground cement particles so as to penetrate the screen segment.

6. The method of claim 1 wherein in step (d) the resistance to flow through a selected screen segment is decreased by injecting a stimulation fluid through the segment.

7. The method of claim 6 wherein the stimulation fluid comprises an acid solution.

8. The method of claim 6 wherein the stimulation fluid comprises a solvent solution.

9. The method of claim 1 wherein the screen segments comprise pre-packed screen.

10. The method of claim 1 wherein the screen segments comprise slotted liner.

11. The method of claim 1 wherein the segments of blank pipe are at least 20 feet in length.

12. A method for improving the production from a horizontal well drilled through an unconsolidated formation and having in the horizontal portion of the wellbore at least two segments of screen separated by segments of blank pipe comprising:

(a) placing packers in blank pipe segments to isolate a selected segment of screen for injection of fluid through the screen segment; and (b) injecting a treating fluid through the selected segment of screen.

13. The method of claim 12 wherein the flow resistance between segments of screen is measured after step (a).

14. The method of claim 12 wherein the treating fluid injected in step (b) increases the flow resistance through the selected segment of screen.

15. The method of claim 12 wherein matrix cement is injected in step (b).

16. The method of claim 12 wherein the treating fluid injected in step (b) is a stimulation fluid.

17. The method of claim 16 wherein the stimulation fluid comprises an acid.

18. The method of claim 16 wherein the stimulation fluid comprises a solvent.

19. The method of claim 16 wherein the stimulation fluid comprises a surfactant.

* * * * *